US006719578B1

(12) United States Patent
Klassen et al.

(10) Patent No.: US 6,719,578 B1
(45) Date of Patent: Apr. 13, 2004

(54) SUBMERSIBLE ELECTRICAL CABLE CONNECTOR

(75) Inventors: William Klassen, Davis, CA (US); Tyler Schilling, Woodland, CA (US); Jeff Kroll, Davis, CA (US)

(73) Assignee: Schilling Robotics, Davis, CA (US)

( * ) Notice: Subject to any disclaimer, the term of this patent is extended or adjusted under 35 U.S.C. 154(b) by 0 days.

(21) Appl. No.: 10/071,830

(22) Filed: Feb. 6, 2002

(51) Int. Cl.[7] ..... H01R 13/28
(52) U.S. Cl. ..... 439/289; 439/20
(58) Field of Search ..... 439/20–23, 289, 439/201, 67, 492

(56) References Cited

U.S. PATENT DOCUMENTS

| | | | | |
|---|---|---|---|---|
| 3,784,959 A | | 1/1974 | Horton | 339/60 M |
| 3,997,230 A | | 12/1976 | Secretan | 339/49 R |
| 4,722,695 A | | 2/1988 | Zwicker et al. | 439/275 |
| 5,037,322 A | * | 8/1991 | Adams et al. | 439/357 |
| 5,704,792 A | * | 1/1998 | Sobhani | 439/21 |
| 5,885,108 A | | 3/1999 | Gerrans | 439/606 |
| 5,888,083 A | | 3/1999 | Seilhan et al. | 439/161 |
| 5,993,272 A | | 11/1999 | Wood et al. | 439/891 |
| 6,009,950 A | | 1/2000 | Cunningham et al. | 166/344 |
| 6,020,276 A | | 2/2000 | Hoyes et al. | 442/185 |
| 6,223,675 B1 | | 5/2001 | Watt et al. | 114/312 |

FOREIGN PATENT DOCUMENTS

FR 2 584 874 7/1985

* cited by examiner

*Primary Examiner*—Renee Luebke
*Assistant Examiner*—Ann McCamey
(74) *Attorney, Agent, or Firm*—Sheppard, Mullin, Richter & Hampton LLP

(57) ABSTRACT

A submersible electrical cable connector having a cable-side connector assembly and a receptacle-side connector assembly. The cable-side connector assembly including a flex-circuit having a circular head with a plurality of pins arranged in a symmetrically shaped configuration. The receptacle-side connector assembly including a molded contact conductor having a number of concentric conductive rings with insulating material positioned between each ring. Each concentric conductive ring makes a physical and electrical connection with at least one the pins in the symmetrically shaped configuration when the cable-side connector assembly and the receptacle-side connector assembly are coupled together.

19 Claims, 5 Drawing Sheets

FIG. 1
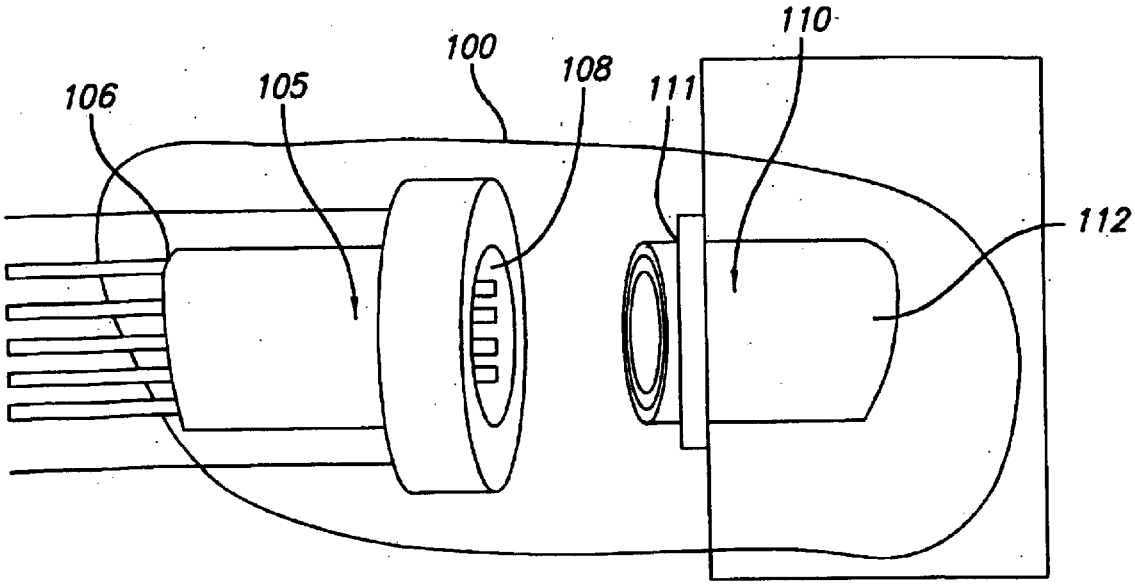
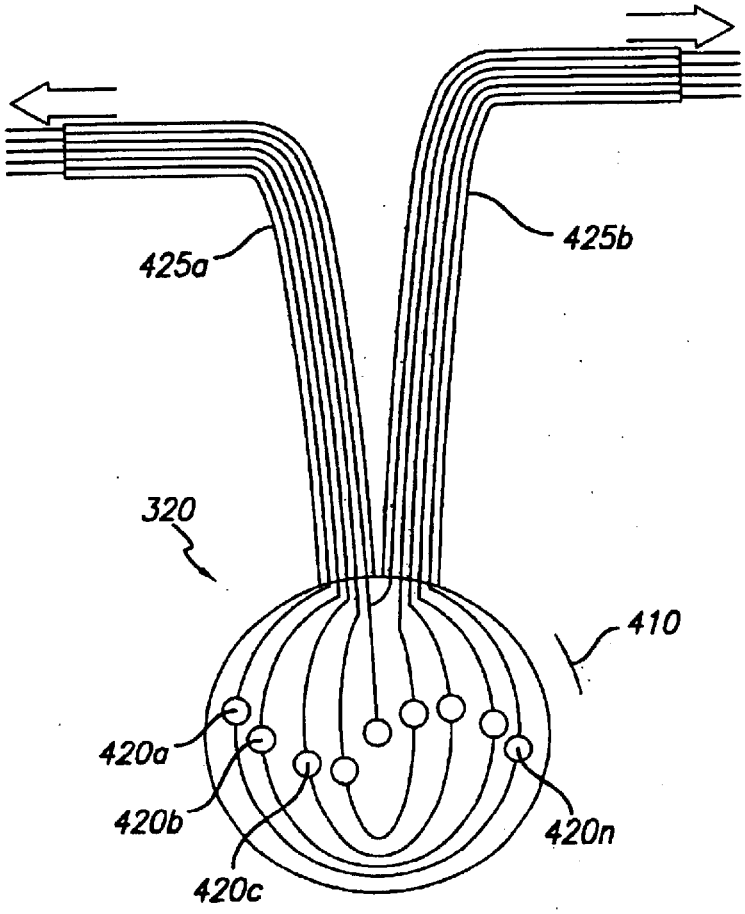
FIG. 4

SUBMERSIBLE ELECTRICAL CABLE CONNECTOR

FIELD OF THE INVENTION

The present invention generally relates to electrical cable connectors. More particularly, the invention relates to electrical cable connectors that are suitable for use in an underwater environment.

BACKGROUND OF THE INVENTION

There is an increasing demand for reliable submersible electrical cable connectors for use in oceanic military applications, including submarines and other submersible vehicles, in underwater research and exploration applications, in ocean mining applications, and in offshore oil drilling applications. In the design of these submersible electrical cable connectors, several factors must be considered.

A first such factor that must be considered in designing a submersible electrical cable connector is the ability of the connector to withstand increasingly high pressures as underwater depth levels increase. High pressures can crush or otherwise deform electrical cable connectors that are not properly designed to withstand such pressures. One way to overcome the effect of high pressures is to equalize the pressure by filling the connector with a pressure equalizing fluid, such as oil. Pressure equalization minimizes the effects of the water pressure on the connector. However, it is important that the oil be used once the connector is in actual use and that the oil be easily introduced into and removed from the connector. Accordingly, what is needed is a submersible electrical cable connector which can withstand high water pressures by using a pressuring equalizing fluid.

A second factor to be considered is the ease and ability in establishing a valid and efficient connection and the ability to maintain that connection under increased pressure and underwater depths. Most underwater or submersible connectors use a pin/socket assembly found in conventional land-based electrical cable connectors. The pin/socket assembly is usually encased and sealed and may be surrounded by oil in order to prevent deformities which may result from excessive water pressures found at increasing underwater depth levels. One such connector which utilizes a pin/socket assembly may be found in U.S. Pat No. 5,888,083 issued to Seilhan et al. As illustrated in FIG. 4 of that patent, this connector relies on a traditional pin/socket assembly such that the pins must be aligned with the holes in the socket on the receiving end in order for a valid connection to be established.

One disadvantage of this type of arrangement is that it is often difficult to align the traditional pin/socket assembly as they require exact angular alignment. Moreover, under increasing high pressures, the pins in a traditional pin/socket assembly may become distorted or misaligned, making connection difficult if not altogether impossible. Accordingly, what is needed is a submersible connector that is easy to connect over and over and which maintains its connectivity even after extensive use at increasing underwater depths. The present invention satisfies this need.

SUMMARY OF THE INVENTION

The present invention is embodied in a submersible electrical cable connector having a cable-side connector assembly and a receptacle-side connector assembly. The cable-side connector assembly includes a flex-circuit having a circular head with a unique pin assembly having a plurality of pins arranged in a symmetrically shaped configuration, such as an S or X configuration. The receptacle-side connector assembly includes a molded contact receptor having a number of concentric conductive rings with insulating material positioned between each ring. In a preferred embodiment, each concentric conductive ring will make a physical and electrical connection with at least two of the pins in the symmetrically shaped configuration when the cable-side connector assembly and the receptacle-side connector assembly are coupled together.

In a preferred embodiment, the symmetrically shaped configuration of pins extends from the cable-side connector assembly through an exterior contact plate having beveled edges. Each of the pins is stabilized by a first force applied from a wave spring and a rubberized contact pad. The first force is applied in an outward direction, thereby causing the exterior contact plate and the pins to project outward. However, when the receptacle-side connector assembly and the cable-side connector assembly are coupled together, the molded contact receptor pushes against the pins, thereby applying a second force in the opposite direction, and forcing the wave spring and rubberized contact pad to contract slightly. As the wave spring and rubberized contact pad contract, the pins and exterior contact plate move inward, opening a pathway around the beveled edges of the exterior contact plate, where oil may then freely flow into the cable side connector assembly and equalize the pressure.

When the submersible cable connector of the present invention is fully assembled, the cable-side connector assembly will fit over the receptacle-side connector assembly in a simple push fashion without the need for any angular alignment of a pin/socket assembly. The cable-side connector assembly can be coupled to the receptacle-side connector assembly without the need for any angular alignment of pins and sockets. Instead, the connector halves are coupled using a mere push type arrange which ensures a proper connection regardless of angular direction.

In a preferred embodiment, fly grips in a quick release latch in the cable-side connector assembly engage a lipped outer edge ring of the receptacle-side connector assembly, thereby forming a secure physical locking link between the cable-side connector assembly and the receptacle-side connector assembly of the submersible cable connector of the present invention. A rubberized boot assembly within the cable-side connector assembly provides a water-tight seal which protects the internal elements of the cable connector from the water as it is submersed.

BRIEF DESCRIPTION OF THE DRAWINGS

FIG. 1 illustrates a preferred embodiment of the submersible cable connector 100 of the present invention;

FIG. 4 illustrates a perspective view of a preferred embodiment of a flex-circuit utilized in the submersible cable connector of the present invention;

DETAILED DESCRIPTION OF PREFERRED EMBODIMENTS

Figure 2:
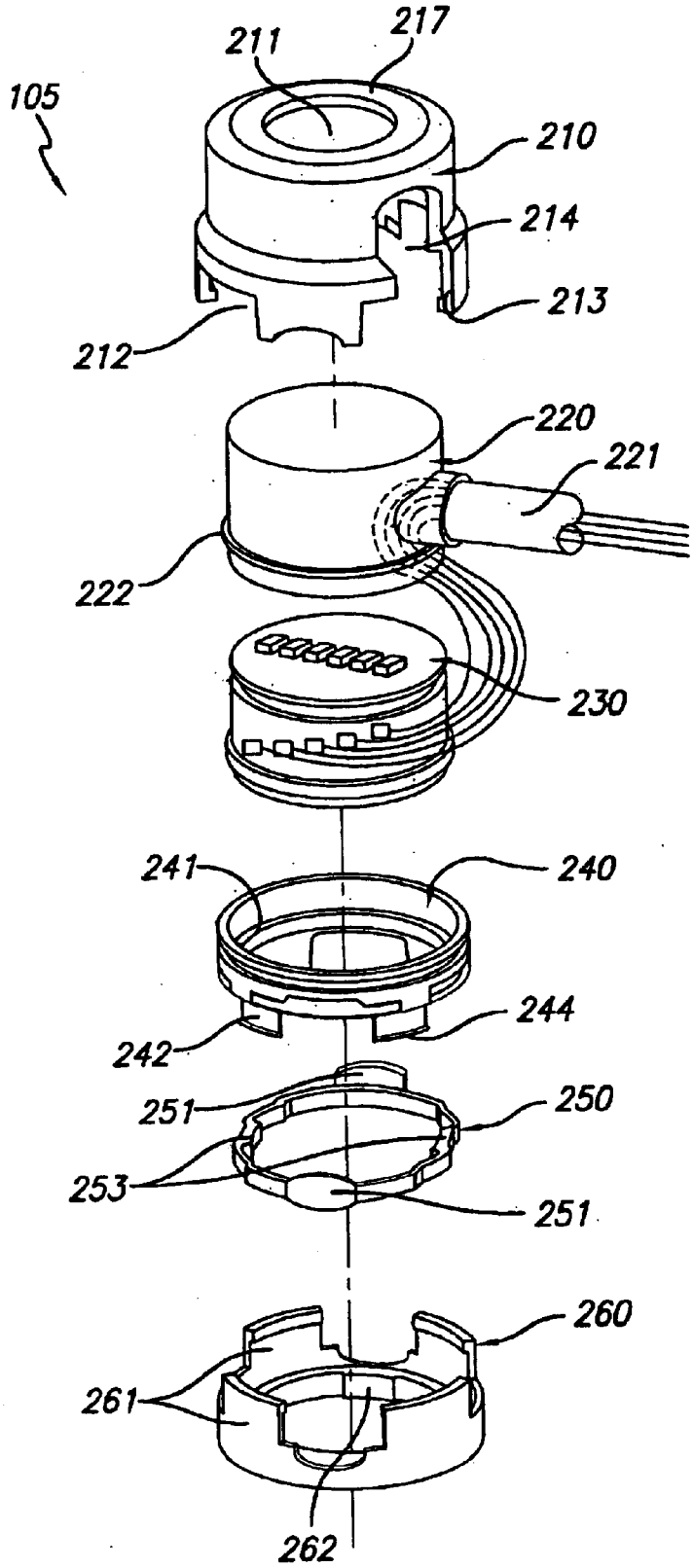
FIG. 2 illustrates a preferred embodiment of the cable side connector assembly of the submersible cable connector of the present invention.

FIG. 1 illustrates a preferred embodiment of the submersible electrical cable connector 100 of the present invention. As shown, the submersible electrical cable connector includes a cable-side connector assembly 105 that receives the cable/wires which are to be coupled to an underwater device or module. The cable-side connector assembly is coupled to a receptacle-side connector assembly 110. The receptacle-side connector assembly is attached to the underwater device or module to which the cable/wires are to be coupled. The submersible electrical cable connector is designed for underwater use in research and exploration, ocean mining, offshore drilling, and other applications. Preferably, it can be used at underwater depths of up to about 6500 meters.

As shown in FIG. 1, the cable side connector assembly 105 has two ends. A first end is a cable end 106 through which the electrical cable/wires which are to be coupled enter the cable-side connector assembly. A second end is a pin end 108 from which a number of conductive pins arranged in a symmetrical design, such as an X or an S shaped configuration, are disposed for coupling the cable side connector assembly 105 to the receptacle side connector assembly 110.

As described earlier, the receptacle-side connector assembly 110 is coupled to the underwater device or module and also has two ends. A first end is an actuator end 111, which preferably includes a exterior nozzle for coupling the cable-side connector assembly 105 to the receptacle-side connector assembly 110. A second end is a conductive receptor end 112 which extends into the interior of the underwater device or module, and couples with wires or electrical traces (not shown) resident within the underwater device or module. Accordingly, the pin end 108 of the cable-side connector assembly is coupled with the actuator end 111 of the receptacle-side connector assembly in order to form the complete submersible electrical cable connector of the present invention.

FIG. 2 illustrates a preferred embodiment of the cable-side connector assembly 105 of the submersible electrical cable connector of the present invention. As shown, the cable-side connector assembly is comprised of a connector sheath 210 which contains the remainder of the components of the cable-side connector assembly and holds all of the elements together within the submersible electrical cable connector of the present invention when it is completely assembled.

The connector sheath 210 is preferably formned of a durable plastic and includes a hollow interior cavity 211 for housing the remaining elements, including a boot assembly 220 and cartridge sub-assembly 230. The connector sheath includes a number of rectangular apertures 212 positioned along a bottom edge of the connector sheath and a number of interior flanges 213 directed inward toward the interior cavity 211. The flanged edges 213 are used for coupling the connector sheath with a carrier latch 240 and securing the boot assembly within the interior cavity of the connector sheath. The rectangular apertures 212 are used for coupling the connector sheath 210 with a retainer latch 260. The connector sheath also includes an oblong opening 214 which is disposed between the interior cavity 211 and the exterior of the connector sheath. The oblong opening 214 accommodates a cabling shaft 221 on the boot assembly 220, and allows the cabling shaft to extend outwardly from the interior cavity 211 of the connector sheath to the exterior of the connector sheath.

As further shown in FIG. 2, the connector sheath 210 fits over a boot assembly 220 which is housed in the interior cavity of the connector sheath. The boot assembly is preferably formed of a transparent or translucent rubberized material and sized to fit snugly within the interior cavity of the connector sheath 210. The boot assembly protects the cartridge subassembly from the water and provides a waterproof seal when the electrical cable connector is fully assembled. The connector sheath is preferably equipped with a large opening 217 located at the top of the connector sheath such that the transparent or translucent rubberized material of the boot assembly is visible through the top of the connector sheath.

Preferably, the boot assembly 220 includes the cable shaft 221, which is a hollow tube also formed of transparent or translucent rubber which extends outward from the interior cavity of the connector sheath. The cable shaft is where the electrical wires that are to be coupled using the submersible electrical cable connector will enter the cable-side connector assembly 105. The boot assembly 220 further includes a ridged mating ring 222 which surrounds the lower circumference of the boot assembly such that it is visible just below the rectangular apertures 212 in the connector sheath 210 when the boot assembly is inserted into the interior cavity of the connector sheath 210. This ridged mating ring 222 has several purposes. First, the ridged mating ring 222 couples and retains the boot assembly within the interior of the connector sheath. Second, the flanged edges 213 of the connector sheath grip onto the corner latch and retain it within the interior of the connector sheath.

The boot assembly 220 fits over, surrounds and insulates a cartridge subassembly 230. The incoming wires extend through the cable shaft and into the cartridge sub-assembly 230. The cartridge sub-assembly is described in greater detail with reference to FIG. 3, further hereinafter. One important feature is the inclusion of a pin assembly having a plurality of pins arranged in a symmetric configuration, such as an S or X shaped configuration. The pins in the symmetrically shaped pin assembly will electrically couple with conductive concentric rings on a surface of a receptor housed in the receptacle-side connector assembly 110 of the submersible connector of the present invention. In a preferred embodiment, at least one pin of the symmetrically shaped pin assembly will make physical contact with each individual conductive concentric ring, thereby establishing a reliable electrical connection. This design eliminates the utilization of a traditional pin/socket assembly and makes for easier connection of the cable-side connector assembly with the receptacle-side connector assembly. Angular alignment of pins and sockets is no longer needed and the cable-side connector assembly and receptacle side connector assembly can be coupled together with reduced effort.

As explained earlier, and as further illustrated in FIG. 2, the cable-side connector assembly 105 of the submersible cable connector of the present invention includes a carrier latch 240 formed of durable plastic and having a grooved inner ring 241 surrounding the interior circumference of the carrier latch. This grooved inner ring 241 couples the carrier latch with the boot assembly 220 (the grooved inner ring 241 of the carrier latch coupling with the ridged mating ring 222 of the boot assembly) such that the carrier latch covers the bottom of the boot assembly 220 when the submersible cable connector of the present invention is fully assembled. In a preferred embodiment, the carrier latch 240 has downward extending arms 242, each downward extending arm having an outwardly flanged bottom edge 244.

The cable-side connector assembly further includes a quick-release locking latch 250 which is preferably formed of durable plastic and includes quick-release press buttons 251 located on opposite sides of the quick-release locking latch. The quick-release locking latch 250 preferably has a pair of fly grips 253 which are formed as part of the latch. The fly grips are disposed at 90 degree angles from each of the quick-release press buttons 251 and extend inward slightly toward the center of the quick-release locking latch 250. When the quick-release press buttons are pressed inward the quick-release locking latch 250 changes shape, causing the fly grips 253 to move outward and away from the center of the latch 250.

Finally, the cable-side connector assembly of the submersible connector of the present invention includes a retainer latch 260 that couples with the connector sheath 210 to provide a complete enclosure. The retainer latch is circular and preferably formed of durable plastic. It has upward extending arms 261 that mate with the rectangular apertures 212 in the connector sheath 210. The retainer latch 260 further includes alignment extenders 262 that extend slightly inward at the bottom of the retainer latch. These alignment extenders engage the downward extending arms 242 of the carrier latch 240 such that the flanged bottom edge 244 of each downward extending arm of the carrier latch 240 extends over and interlocks with the alignment extenders 262.

Figure 3:
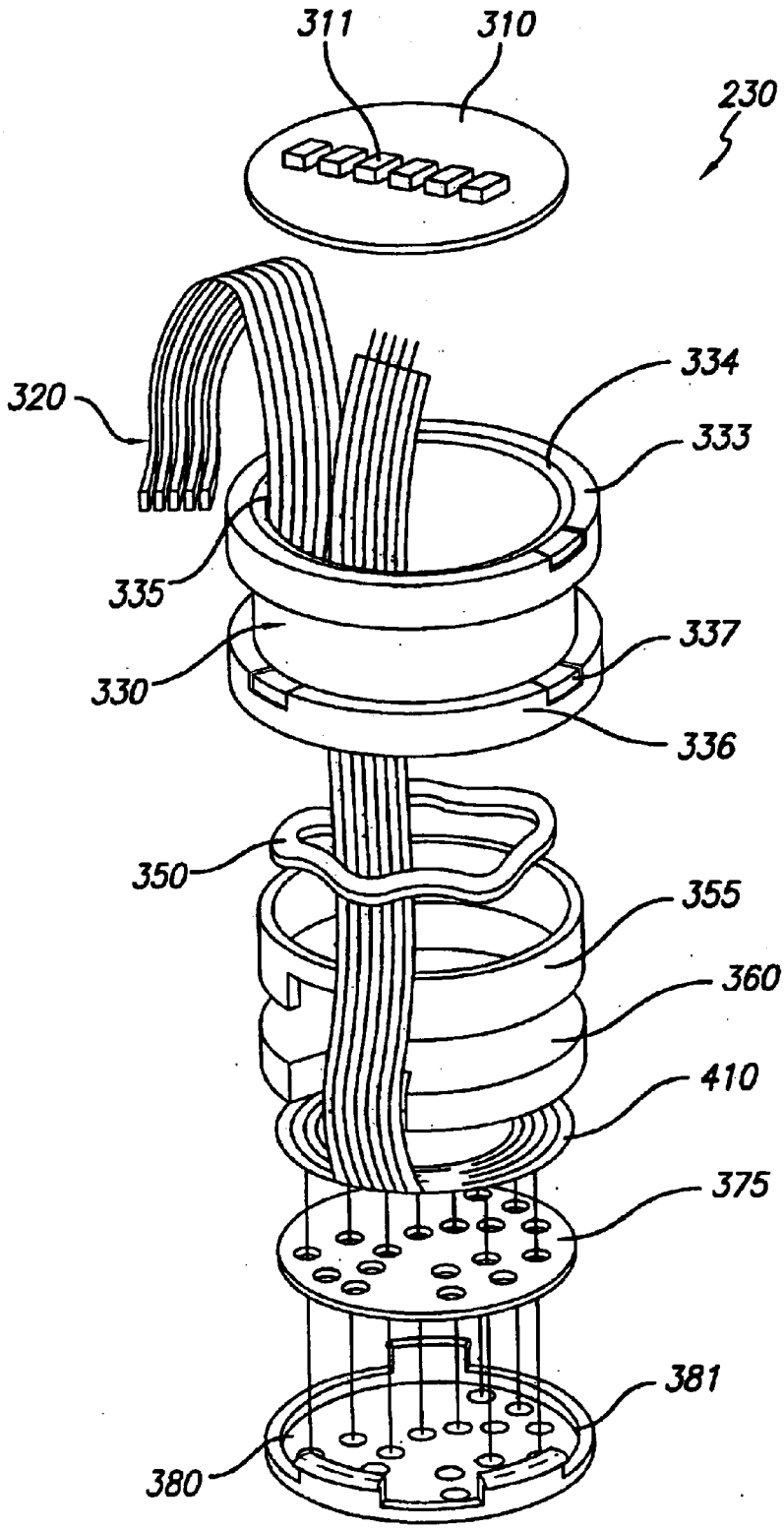
FIG. 3 illustrates a preferred embodiment of a cartridge subassembly which is housed in the cable side connector assembly of the submersible cable connector of the present invention.

FIG. 3 illustrates a preferred embodiment of a cartridge sub-assembly 230 housed in the cable-side connector assembly of the submersible electrical cable connector of the present invention. As shown, the cartridge sub-assembly 230 is comprised of a printed circuit board (PCB) 310 that is preferably circular in shape and which preferably includes at least one LED indicator 311. In a preferred embodiment, the LED indicator will light up when a valid electrical connection is made between the pins of the cable-side connector assembly and the conductive concentric rings of the receptacle-side connector assembly. As explained earlier, the connector sheath 210 is preferably equipped with a large opening 217 located at the top of the connector sheath such that the transparent or translucent rubberized material of the boot assembly is visible through the connector sheath. Accordingly, the LED is visible through the transparent or translucent rubberized material of the boot assembly and the large opening at the top of the connector sheath.

As further illustrated in FIG. 3, a flex circuit 320 is disposed throughout the cartridge-sub-assembly. FIG. 4 illustrates a closer view of a preferred embodiment of the flex circuit. As shown in FIG. 4, the flex circuit 320 has a flat circular head 410 with an arrangement of pins 420*a–n* extending or protruding therefrom, and two first ends 425*a–b* extending outwardly from the circular head. The two first ends 425*a–b* include electrical traces which are insulated within thin, flexible, durable film-like coverings which are preferably formed of Kapton. The two first ends 425*a–b* extend outward from the circular head such that each individual pin has two different electrical traces extending outwardly therefrom, one disposed along one of the first ends 425*a* and a second disposed along the other first end 425*b*. One of the first ends 425*a* which extends outwardly from the circular head is coupled to the PCB 310. The other first end 425*b* is directed up through the boot assembly and is coupled to the wires which are disposed through the cabling shaft 221 of the boot assembly 220.

Referring again to FIG. 3, the cartridge sub-assembly further includes a main cartridge body 330. The main cartridge body is preferably cylindrical in shape and preferably formed of durable plastic. The main cartridge body has top and bottom ridged edges 333 and 336, respectively. The top ridged edge 333 extends slightly outward from the circumference of the main cartridge body and forms a sunken reception reservoir 334 within the top of the main cartridge body 330. In a preferred embodiment, this sunken reservoir houses the PCB 310. The bottom ridged edge 336 is preferably thicker in height than the top ridged edge 333, extending outward from the circumference of the main cartridge body and forming a reception ring at the bottom of the main cartridge body. The bottom ridged edge 336 preferably has three opposing apertures 337 which are disposed about the circumference of the reception ring on the bottom of the main cartridge. These opposing apertures will be used for coupling a contact plate, as described further hereinafter.

The main cartridge body houses a wave spring 350, a spring contact plate 355 and a contact pad 360. The wave spring 350 is preferably a circular shaped spring formed of a resilient metal. The spring contact plate 355 is also circular in shape and preferably formed of a durable plastic. The contact pad 360 is preferably a cylindrically shaped rubberized pad having a preferred thickness of approximately ⅛ of an inch It is understood that alternative thickness may be used depending upon the application and design. The wave spring 350, the spring contact plate 355, and the contact pad 360 all operate in concert in order to apply a force to the backside of the circular head 410 of the flex circuit, which is preferably folded over onto and aligned with the contact pad 360.

Finally, the cartridge sub-assembly is comprised of a rubberized contact seal 375 and exterior contact plate 380. The contact seal 375 fits into a back side 381 of the exterior contact plate 380. Both the contact seal 375 and the exterior contact plate 380 are equipped with holes which form also for a unique symmetrically shaped pattern on their surfaces. These holes are aligned when the contact seal and exterior contact plate are mated. The holes are designed to match the symmetrically shaped pin configuration pattern which protrudes from the circular head 410 at the end of the flex circuit 320. Accordingly, in a preferred embodiment, the wave spring, the spring contact plate and the contact pad operate to apply a force to the backside of the circular head 410 of the flex circuit, forcing the symmetrically shaped arrangement of pins which protrude from the front side of the circular head 240 to extend through the contact seal 375 and exterior contact plate 380 and out the other side (the pin side) of the cable-side connector assembly. Preferably, the hole sizes in the contact seal 375 are slightly smaller than the diameter of the pins which protrude from the circular head of the flex-circuit. Therefore, a tight seal is formed around the pins as they are forced through the holes in the contact seal and exterior contact plate.

In a preferred embodiment of the present invention, the contact plate 380 has beveled edges. When the receptacle-side connector assembly and the cable-side connector assembly are coupled together, the molded contact conductor of the receptacle-side pushes against the pins on the cable-side and applies a force in the opposite direction (against the wave spring and contact pad), thereby forcing the wave spring and rubberized contact pad to contract slightly and opening a recess around the beveled edges of the contact plate. A pressure equalizing fluid, such as oil, may then freely flow into the cable-side connector assembly and reduce the effects of water pressure on the submersible cable connector by equalizing the pressure.

Figure 5:
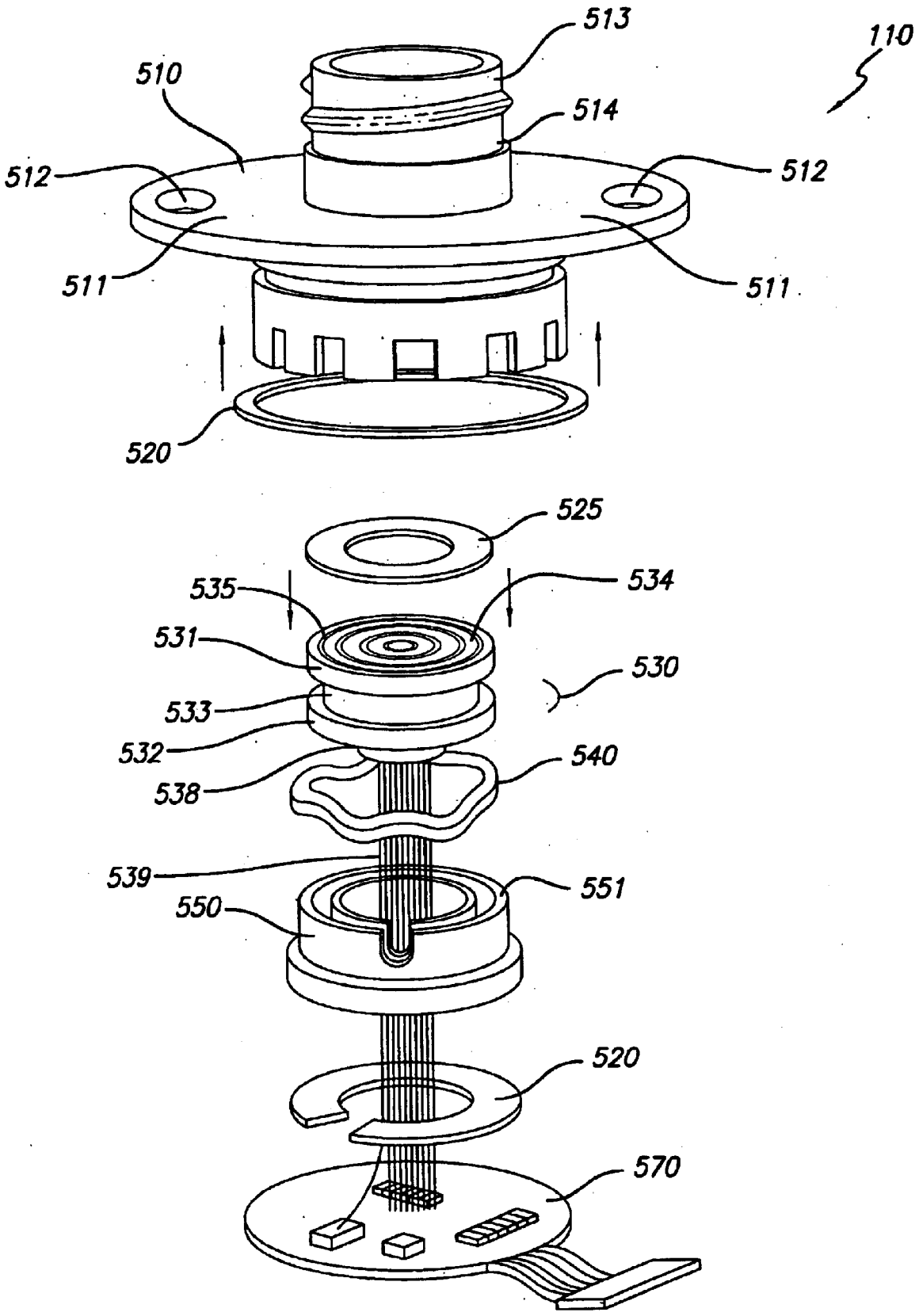
FIG. 5 illustrates a preferred embodiment of the receptacle side connector assembly for the submersible cable connector of the present invention.

FIG. 5 illustrates a preferred embodiment of the receptacle-side connector assembly 110 for the submersible electrical cable connector of the present invention. As show in FIG. 5, the receptacle-side connector assembly includes a hub actuator shell 510 formed from a durable plastic and having fly wings 511 disposed on opposite sides of the actuator shell 510. The hub actuator shell is attached to the exterior or the interior of the underwater device or module to which the cable-side connector assembly is to be connected. Preferably, the hub actuator shell is attached to the underwater device or module via screws or bolts which fit through attachment holes 512 located in the fly wings 511 of the actuator shell 510.

The actuator shell 510 includes a circular shaped nozzle 513 which extends outward from the actuator shell 510 (away from the underwater device or module) and having a lipped outer edge ring 514. When the submersible cable is fully assembled, the cable-side connector assembly will fit over the circular shaped nozzle of the receptacle-side connector assembly in a straight-forward push type fashion, without the need for any angular alignment of pins/sockets. When the cable-side connector assembly and the receptacle-side connector assembly are properly connected, the fly grips in the quick release latch will engage the lipped outer edge ring of the actuator shell, thereby forming a secure locking link between the cable side connector assembly and the receptacle side connector assembly of the submersible electrical cable connector of the present invention. An interior lipped edge of the boot assembly will also engage the actuator shell, thereby forming a water tight seal between the cable side connector assembly and the receptacle side connector assembly of the submersible electrical cable connector.

In a preferred embodiment, the actuator shell has a hollow interior which houses the molded contact receptor 530 and O-ring 525. An additional O-ring 520 is preferably positioned about the circumference of the activator shell 510. The O-ring 525 provides a secure seal such that the molded contact receptor fits snugly and securely within the actuator shell without making actual physical contact between the conductive surface of the molded contact receptor and the actuator shell 510. However, when the cable-side connector assembly and the receptacle-side connector assembly are properly connected, the O-ring is pushed back, thereby providing space for oil to flow from the cable-side connector assembly and into the receptacle-side connector assembly, in order to equalize the pressure in the cable connector.

In a preferred embodiment, the molded contact receptor 530 is pressed into and retained within the actuator shell using a wave spring 540 and spring retainer 550, which fit into a back side of the actuator shell. The wave spring is preferably circular in form and made of a resilient metal. The spring retainer is preferably formed of durable plastic. The spring retainer 550 preferably includes a circular channel 551 on the inside of said retainer for holding the wave spring 540 into place.

As further illustrated in FIG. 5, the molded contact receptor 530 is preferably cylindrical in shape and having an upper 531 and lower 532 circumference with a channel 533 for housing O-ring 525 disposed therebetween. In a preferred embodiment, the lower circumference is slightly larger than the upper circumference such that when the cable-side connector assembly and the receptacle-side connector assembly are coupled together, space is created about between the interior surface of the actuator shell 510 and the upper circumference, thereby allowing the pressure equalizing fluid, such as oil, to flow through the receptacle-side cable connector and actually into the receiving device in order to equalize the water pressure on the device.

In a preferred embodiment, the molded contact receptor has a front surface 534 and a back side surface 538. The front surface of the molded contact receptor is comprised of a number of concentric conductive rings 535 with insulating material, such as plastic, disposed between each conductive ring and along the outer perimeter of the front surface of the molded contact conductor. The concentric conductive rings 535 make a physical and electrical connection with the symmetrically shaped arrangement of pins which extend through the contact seal 375 and contact plate 380 of the cable-side connector assembly 105 when the entire submersible cable connector is assembled.

The back surface of the molded contact receptor has metallic conductive strips 539 extending therefrom, in an outward fashion. Each one of these metallic conductive strips is an extension of one of the conductive concentric rings on the front surface, such that each ring has an associated strip extending from the back side of the molded contact conductor. The strips and the conductive concentric rings are preferably formed of a lightweight conductive metal such as copper.

In a preferred embodiment, the conductive strips 539 which extend from the back surface of the molded contact receptor are coupled to a printed circuit board 570. Preferably, a retaining ring 560 is disposed between the spring retainer 550 and the printed circuit board 570. In a preferred embodiment, the retaining ring does not make actual physical contact with the printed circuit board 570. In a preferred embodiment, the printed circuit board monitors the connection in the submersible electrical cable connector and allows for remote shut-off or disconnect of the underwater device to which the cable is coupled, if water gets into the cable/connector.

Figure 6:
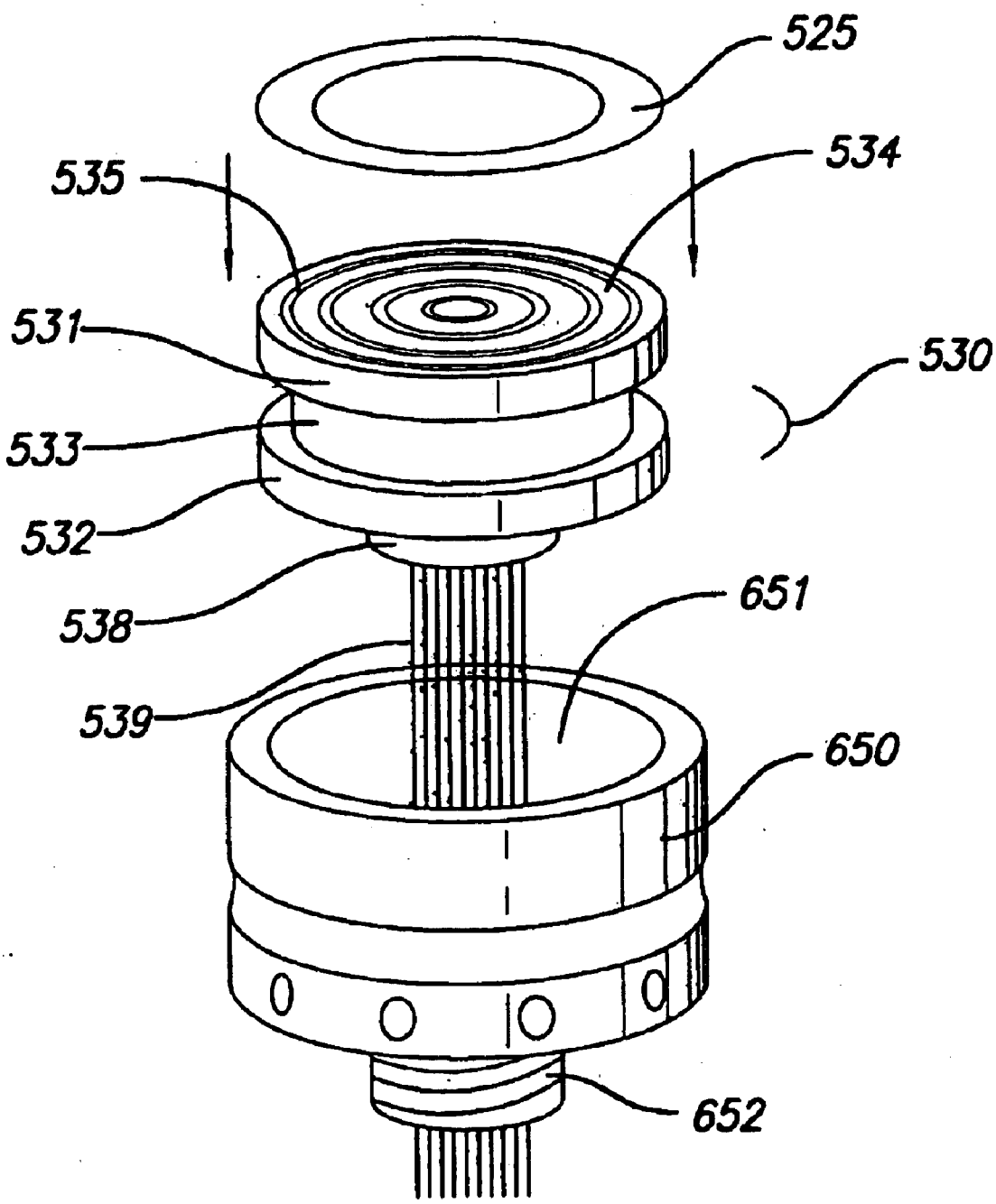
FIG. 6 illustrates an alternative embodiment of the receptacle side connector assembly for the submersible cable connector of the present invention.

In some situations, it is desireable to have pressurizing fluid, such as oil, within the cable only and not allow the oil to flow into the actual underwater device. FIG. 6 illustrates an alternative embodiment of the receptacle side connector assembly for the submersible cable connector of the present invention. The embodiment illustrated in FIG. 6 is used when it is desireable not to have the pressurizing fluid flow into the underwater device but only within the cable and connector itself As shown, in the receptacle-side connector assembly in FIG. 6, the molded contact receptor 530 is housed within an interior 651 of a metallic housing element 650 and is held into place by O-ring 525 which is positioned about the circumference of the molded contact receptor 530.

The metallic housing element 650 is preferably formed of sturdy steel alloy and has a rear screw mount 652. The rear screw mount provides a channel into the interior of the metallic housing element. The molded contact conductor is housed in the interior and the metallic conductive strips 539 extending therefrom are disposed within the channel and extend out through the rear screw mount 652. A cable or wire assembly (not shown) within the underwater device may be coupled with the rear screw mount 652 in a conventional fashion, with the individual wires within the underwater device or module being coupled to each one of the metallic conductive strips.

The foregoing description details certain preferred embodiments of the present invention and describes the best mode contemplated. It will be appreciated, however, that the invention can be practiced in many ways and is not intended to be limited or restricted in any fashion except as defined in the claims which follow, and any equivalents thereto.

What is claimed is:

1. A submersible cable connector assembly comprising:

a cable-side connector assembly that includes a flex circuit having a circular head with a plurality of pins protruding therefrom;

a receptacle-side connector assembly that includes a molded contact receptor having a plurality of concentric conductive rings with insulating material positioned between each ring, each concentric conductive ring electrically coupling with at least one of the pins when the cable-side connector assembly and the receptacle-side connector assembly are coupled together; and a spring disposed behind the flex circuit, wherein the spring applies a force on the circular head of the flex circuit and urges more than one of the pins of the plurality of pins to make contact with the more than one concentric conductive rings of the molded contact receptor when the cable-side connector assembly and the receptacle-side connector assembly are coupled together.

2. The submersible cable connector assembly of claim 1, wherein the plurality of pins are arranged in a symmetrical configuration.

3. The submersible electrical cable connector of claim 1, wherein the cable-side connector assembly further includes a boot assembly having a cable shift extending therefrom through which wires from a cable extend into the cable side connector assembly.

4. The submersible electrical cable connector of claim 3, wherein the flex circuit includes two first ends which extend from the circular head, the first ends comprised of electrical traces insulated within a thin, flexible, durable film-like covering, one of the first ends coupling each individual pin in the plurality of pins to a PCB; and the other of the first ends coupling each individual pin in the plurality of pins to one of the wires wich extend into the cable side connector assembly through the cable shaft of the boot assembly.

5. The submersible electrical cable connector of claim 4, wherein the PCB includes at least one LED which illuminates when a valid electrical connection has been established between each of the pins in the plurality and each of the concentric conductive rings in the molded contact receptor.

6. A submersible cable connector assembly comprising:

a cable-side connector assembly that includes a flex circuit having a circular head with a plurality of pins protruding therefrom;

a receptacle-side connector assembly that includes a molded contact receptor having a plurality of concentric conductive rings with insulating material positioned between each ring, each concentric conductive ring electrically coupling with at least one of the pins when the cable-side connector assembly and the receptacle-side connector assembly are coupled together;

a spring;

a spring contact plate coupled to the spring; and a rubberized contact pad coupled between the spring contact plate and the circular head of the flex circuit; the spring, spring contact plate and rubberized contact paid applying a first force to the circular head of the flex circuit and forcing the plurality of pins to make contact with the concentric conductive rings of the molded contact conductor when the cable side-connector assembly and the receptacle-side connector assembly are coupled together;

wherein the cable-side connector assembly further includes a boot assembly having a cable shaft extending therefrom through which wires from a cable extend into the cable side connector assembly;

wherein the flex circuit includes two first ends which extend from the circular head, the first ends comprised of electrical traces insulated within a thin, flexible, durable film-like covering, one of the first ends coupling each individual pin in the plurality of pins to a PCB; and the other of the first ends coupling each individual pin in the plurality of pins to one of the wires which extend into the cable side connector assembly through the cable shaft of the boot assembly.

7. The submersible electrical cable connector of claim 6, wherein the cable-side connector assembly further includes an exterior contact place having a plurality of holes through which the plurality of pins extend, the exterior contact plate having beveled edges such that when the receptacle-side connector assembly and the cable-side connector assembly are coupled together, the molded contact receptor pushes against the plurality of pins and applies a second force in the opposite direction of the first force, thereby forcing the spring and rubberized contact pad to contract slightly and opening a recess around the beveled edges of the contact plate, the recess providing a pathway where pressurizing fluid may then freely flow into the cable-side connector assembly in order to stabilize the pressure within the submersible cable connector.

8. A method for coupling wires to an underwater device, the method comprising:

constructing a cable-side connector assembly having a flex circuit with a circular head and a plurality of pins protruding therefrom;

constructing a receptacle-side connector assembly having a molded contact conductor with front surface comprising a number of concentric conductive rings and insulating material positioned there between;

coupling the cable-side connector assembly to the receptacle-side connector assembly such that each one of the concentric conductive rings electrically couples with at least one of the pins in the plurality; and disposing a spring behind the flex circuit, wherein the spring applies a force on the circular head of the flex circuit and urges more than one of the pins of the plurally pins to make contact with the more than one concentric conductive rings of the molded contact receptor when the cable-side connector assembly and the receptacle-side connector assembly are coupled together.

9. The method of claim 8, wherein the receptacle-side connector assembly is coupled to the underwater device.

10. The method for coupling wires to an underwater device of claim 8, wherein the plurality of pins are arranged in a symmetrical configuration.

11. The method of claim 8, further comprising:

disposing a boot assembly having a cable shaft within the cable-side connector assembly, the cable shaft extending outward from the cable-side connector assembly and providing a channel through which the wires to be coupled to the underwater device extend into the cable-side connector assembly; and coupling each individual pin in the plurality of pins to one of the wires which extend into the cable side connector assembly through the cable shaft.

12. The method of claim 11, further comprising:

providing a printed circuit board (PCB) having at least one LED within the cable-side connector assembly, and coupling each individual pin to the PCB such that the at least one LED on the PCB illuminates when a valid electrical connection has been established between each of the concentric conductive rings and at least one of the pins in the plurality.

13. A method for coupling wires to an underwater device, the method comprising:

constructing a cable-side connector assembly having a flex circuit with a circular head and a plurality of pins protruding therefrom;

constructing a receptacle-side connector assembly having a molded contact conductor with front surface comprising a number of concentric conductive rings and insulating material positioned therebetween;

coupling the cable-side connector assembly to the receptacle-side connector assembly such that each one of the concentric conductive rings electrically couples with at least one of the pins in the plurality;

disposing a boot assembly having a cable shaft within the cable-side connector assembly, the cable shaft extending outward from the cable-side connector assembly and providing a channel through which the wires to be coupled to the underwater device extend into the cable-side connector assembly;

coupling each individual pin in the plurality of pins to one of the wires which extend into the cable side connector assembly through the cable shaft;

disposing a spring within the cable side connector assembly;

coupling a spring contact plate to the spring; and coupling a rubberized contact pad between the spring contact plate and the circular head of the flex circuit such that the spring, spring contact plate and rubberized contact pad apply a force on the circular head of the flex circuit and forcing the pins to make contact with the concentric conductive rings of the molded contact receptor when the cable-side connector assembly and the receptacle-side connector assembly are coupled together.

14. The method of claim 13, further comprising the steps of:

providing an exterior contact plate in the cable-side connector assembly, the exterior contact plate having a plurality of holes through which the pins in the plurality extend, and including beveled edges; and providing pressuring fluid to the cable-side connector assembly when the receptacle-side connector assembly and the cable-side connector assembly are coupled together; the molded contact conductor pushing against the pins and exerting a second force in the opposite direction of the first force, thereby forcing the spring and rubberized contact pad to contract slightly and opening a recess around the beveled edges of the exterior contact plate; the recess providing an pathway where the pressuring fluid may flow freely into the cable-side connector assembly.

15. An underwater cable connector assembly comprising:

a cable-side connector assembly that includes:

a boot assembly having a cable shaft extending therefrom through which wires extend into the cable side connector assembly;

a printed circuit board housed within the boot assembly;

a flex circuit having a circular head with a plurality of pins protruding therefrom, the flex circuit having two first ends which extend from the circular head, the first ends comprised of electrical traces insulated within a thin, flexible, durable film-like covering, one of the first ends coupling each individual pin to the PCB; and the other of the first ends coupling each individual pin in the plurality of pins to one of the wires which extend into the cable side connector assembly through the cable shaft of the boot assembly;

a receptacle-side connector assembly that includes a molded contact receptor having a plurality of concentric conductive rings with insulating material positioned between each ring, each concentric conductive ring electrically coupling with at least one of the plurality of pins when the cable-side connector assembly and the receptacle-side connector assembly are coupled together; and a spring disposed behind the flex circuit, wherein the spring applies a force on the circular head of the flex circuit and urges more than one of the pins of the plurality of pins to make contact with the more than one concentric conductive rings of the molded contact receptor when the cable-side connector assembly and the receptacle-side connector assembly are coupled together.

16. The underwater electrical cable connector of claim 15, wherein the PCB includes at least one LED which illuminates when a valid electrical connection has been established between each of the concentric conductive rings in the molded contact receptor and at least one of the pins of the plurality of pins.

17. The underwater cable connector assembly of claim 15, wherein the plurality of pins are arranged in a symmetrical configuration.

18. An underwater cable connector assembly comprising:

a cable-side connector assembly that includes:

a boot assembly having a cable shaft extending therefrom through which wires extend into the cable side connector assembly;

a printed circuit board housed within the boot assembly;

a flex circuit having a circular head with a plurality of pins protruding therefrom, the flex circuit having two first ends which extend from the circular head, the first ends comprised of electrical traces insulated within a thin, flexible, durable film-like covering, one of the first ends coupling each individual pin to the PCB; and the other of the first ends coupling each individual pin in the plurality of pins to one of the wires which extend into the cable side connector assembly through the cable shaft of the boot assembly;

a receptacle-side connector assembly that includes a molded contact receptor having a plurality of concentric conductive rings with insulating material positioned between each ring, each concentric conductive ring electrically coupling with at least one of the pins when the cable-side connector assembly and the receptacle-side connector assembly are coupled together;

a spring;

a spring contact plate coupled to the spring; and a rubberized contact pad coupled between the spring contact plate and the circular head of the flex circuit;

the spring, spring contact plate and rubberized contact pad applying a first force to the circular head of the flex circuit and forcing the pins to make contact with the concentric conductive rings of the molded contact conductor when the cable side-connector assembly and the receptacle-side connector assembly are coupled together.

19. The submersible electrical cable connector of claim 18, wherein the cable-side connector assembly further includes an exterior contact plate through which the pins in the plurality extend, the exterior contact plate having beveled edges such that when the receptacle-side connector assembly and the cable-side connector assembly are coupled together, the molded contact conductor pushes against the pins and applies a second force in the opposite direction of the first force, thereby forcing the spring and rubberized contact pad to contract slightly and opening a recess around the beveled edges of the plate, the recess providing a pathway where oil may then freely flow into the cable-side connector assembly in order to stabilize the pressure within the submersible cable connector.

* * * * *

UNITED STATES PATENT AND TRADEMARK OFFICE

CERTIFICATE OF CORRECTION

PATENT NO. : 6,719,578 B1
DATED : April 13, 2004
INVENTOR(S) : William Klassen et al.

It is certified that error appears in the above-identified patent and that said Letters Patent is hereby corrected as shown below:

Column 9,
Line 30, change “shift” to -- shaft --

Column 10,
Line 19, change “place” to -- plate --
Line 48, change “plurally” to -- plurality of --

Signed and Sealed this

Eighth Day of June, 2004

JON W. DUDAS
*Acting Director of the United States Patent and Trademark Office*